US010368610B2

(12) United States Patent
Saley

(10) Patent No.: US 10,368,610 B2
(45) Date of Patent: Aug. 6, 2019

(54) VARIABLE ANKLE SUPPORTING SHOE ASSEMBLY

(71) Applicant: Neil Saley, Backus, MN (US)

(72) Inventor: Neil Saley, Backus, MN (US)

( * ) Notice: Subject to any disclaimer, the term of this patent is extended or adjusted under 35 U.S.C. 154(b) by 127 days.

(21) Appl. No.: 15/719,115

(22) Filed: Sep. 28, 2017

(65) Prior Publication Data

US 2019/0090580 A1 Mar. 28, 2019

(51) Int. Cl.

| | |
|---|---|
| ***A43B 7/20*** | (2006.01) |
| ***A43B 3/00*** | (2006.01) |
| ***A43B 23/07*** | (2006.01) |
| ***A43B 5/00*** | (2006.01) |
| ***A43B 1/00*** | (2006.01) |
| ***A43B 23/02*** | (2006.01) |

(52) U.S. Cl.

CPC ..... *A43B 7/20* (2013.01); *A43B 1/0054* (2013.01); *A43B 3/0005* (2013.01); *A43B 5/002* (2013.01); *A43B 23/021* (2013.01); *A43B 23/0215* (2013.01); *A43B 23/0285* (2013.01); *A43B 23/07* (2013.01)

(58) Field of Classification Search

CPC ..... A43B 7/20; A43B 1/0054; A43B 3/0005; A43B 23/07

USPC ..... 36/89

See application file for complete search history.

(56) References Cited

U.S. PATENT DOCUMENTS 3,377,721 A * 4/1968 Johnson ..... A43B 5/0405 12/142 R
4,385,456 A * 5/1983 Livernois ..... A43B 3/0047 36/115
5,203,793 A * 4/1993 Lyden ..... A43B 3/0063 12/142 N
5,711,746 A 1/1998 Carlson
5,985,383 A * 11/1999 Allen ..... A42B 3/121 36/88
7,316,083 B2 * 1/2008 Labonte ..... A43B 5/1666 264/154
7,507,215 B2 3/2009 Ryan
8,696,610 B2 4/2014 Solomon
9,271,538 B2 3/2016 Ellis
9,271,858 B2 3/2016 Ben-Meir et al.
9,572,395 B2 * 2/2017 Roser ..... A43B 5/002
(Continued)

OTHER PUBLICATIONS

Electronic Knee Wrap for Injury Prediction / Dept. of CIS—Senior Design 2013-2014 Alex Yau, Universtiy of Pennsylvania Philadelphia, PA.

*Primary Examiner* — Ted Kavanaugh

(57) ABSTRACT

A variable ankle supporting shoe assembly includes a shoe including a perimeter wall having a lining comprising a foamed material. A magnetorheological fluid impregnates the foamed material and is alternated between a first state wherein the foamed material is bendable and a second state wherein the magnetorheological fluid forms a rigid structure within the foamed material such that the foamed material is not bendable. The lining forms a rigid and supportive shell when the magnetorheological fluid is in the second state. An actuating system alters the magnetorheological fluid from the first state to the second state when a condition has been met. The condition is met when the actuating system detects a combination of a threshold angle and a threshold pressure has been surpassed by the sole.

8 Claims, 3 Drawing Sheets

(56) References Cited

U.S. PATENT DOCUMENTS

| | | | | |
|---|---|---|---|---|
| 2004/0168357 | A1* | 9/2004 | Meibock | A43B 1/0072 36/115 |
| 2012/0238914 | A1 | 9/2012 | Goldfield et al. | |
| 2015/0230961 | A1 | 8/2015 | McGuckin, Jr. | |
| 2016/0178027 | A1 | 6/2016 | Wetzel et al. | |
| 2017/0083085 | A1 | 3/2017 | Rubin et al. | |

* cited by examiner

VARIABLE ANKLE SUPPORTING SHOE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to ankle bracing shoe structures and more particularly pertains to a new ankle bracing shoe structure for preventing injury to ankles by forming a protective and rigid shell around a person's ankle when the structure detects that the structure is being subjected to forces that could damage ligaments in the ankle.

BRIEF SUMMARY OF THE INVENTION

An embodiment of the disclosure meets the needs presented above by generally comprising a shoe including a sole and a perimeter wall that is attached to and extends upwardly from the sole. The perimeter wall is configured to receive a foot. The sole has a top side, a bottom side and a perimeter edge extending between the top and bottom sides. The perimeter wall includes a vamp, a heel panel and an upper. The perimeter wall includes a lining comprising a foamed material. A magnetorheological fluid impregnates the foamed material and is configured to be alternated between a first state wherein the foamed material is bendable and a second state wherein the magnetorheological fluid forms a rigid structure within the foamed material such that the foamed material is not easily bendable. The lining forms a rigid and supportive shell when the magnetorheological fluid is in the second state. An actuating system is mounted on the shoe and is in operational communication with the magnetorheological fluid. The actuating system alters the magnetorheological fluid from the first state to the second state when a condition has been met. The condition is met when the actuating system detects a combination of a threshold angle and a threshold pressure has been surpassed by the sole.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
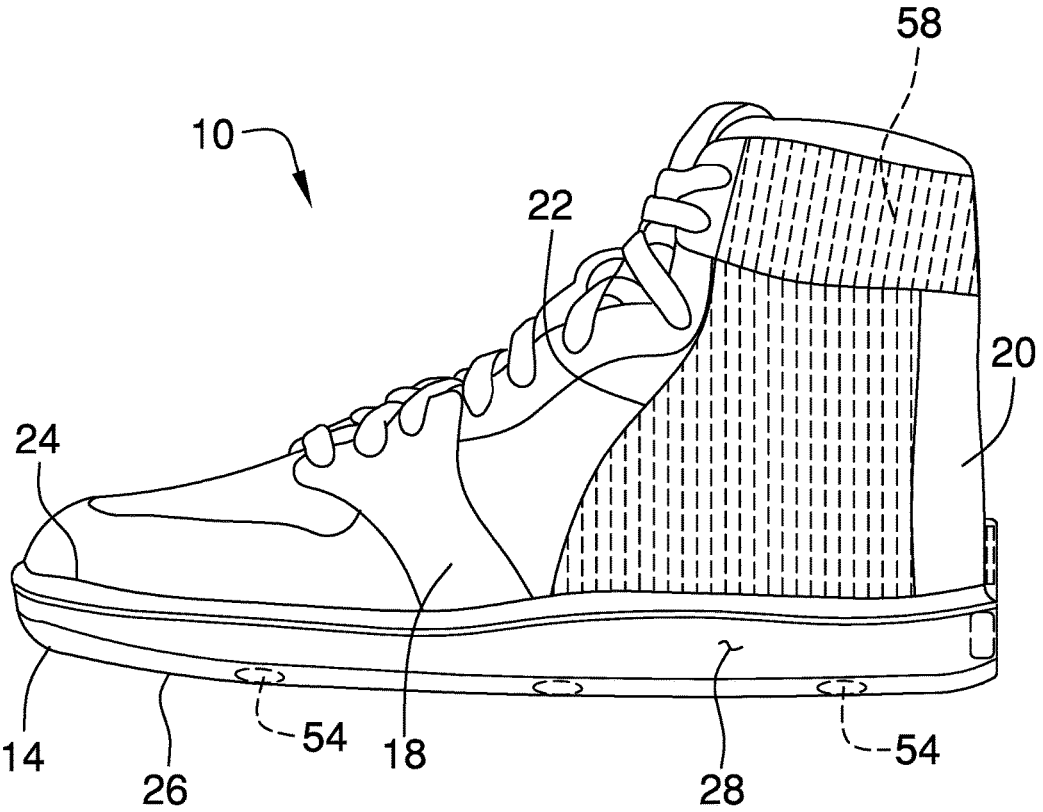
FIG. 1 is a side view of a variable ankle supporting shoe assembly according to an embodiment of the disclosure.
Figure 2:
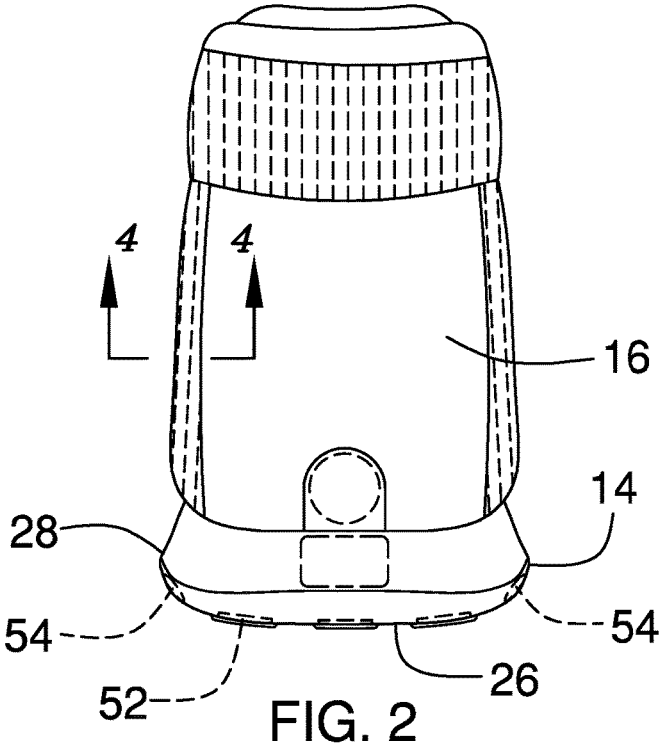
FIG. 2 is a rear view of an embodiment of the disclosure.
Figure 3:
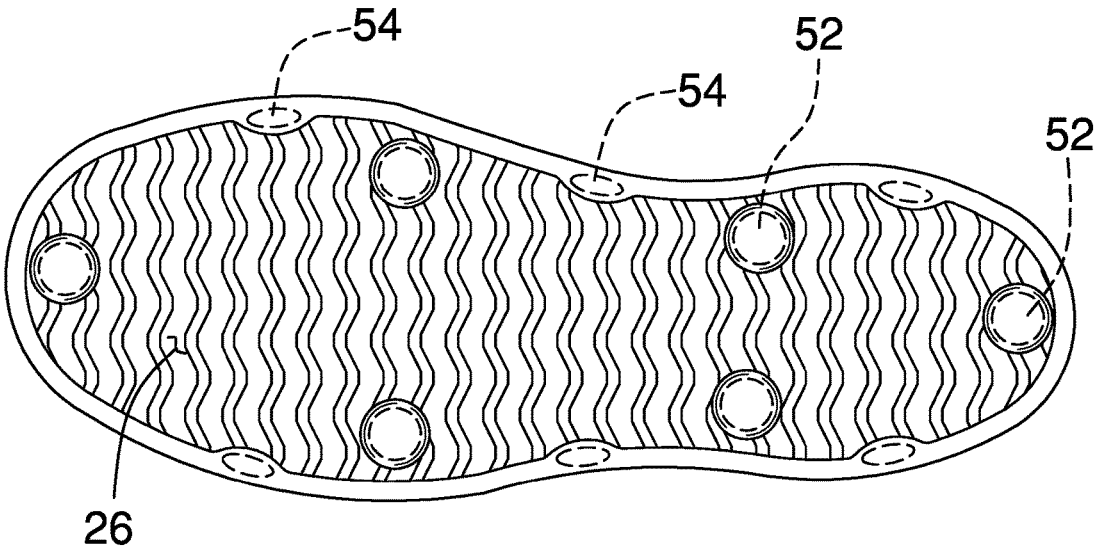
FIG. 3 is a bottom view of an embodiment of the disclosure.

With reference now to the drawings, and in particular to FIGS. 1 through 5 thereof, a new ankle bracing shoe structure embodying the principles and concepts of an embodiment of the disclosure and generally designated by the reference numeral 10 will be described.

As best illustrated in FIGS. 1 through 5, the variable ankle supporting shoe assembly 10 generally comprises a shoe 12 that is generally conventional and includes a sole 14 and a perimeter wall 16 that is attached to and extends upwardly from the sole 14. The perimeter wall 16 is configured to receive a foot and may be formed such that the perimeter wall includes a vamp 18, heel panel 20 and an upper 22. More particularly, the upper 22 may extend upwardly to form a sleeve to form what is colloquially known as a high-top basketball shoe. The upper 22 extends around a wearer's ankle to provide additional bracing support. The upper 22 may include a "U" shaped ridged structural support enclosed within the outer aspect of this space and will typically have a foamed elastomeric lining for flexibility and comfort to the wearer. This will provide ridged support against the medial distal tibia just above the medial malleolus and extends posteriorly around the upper ankle to the lateral area to act as a support for the assembly 10. The sole 14 has a top side 24, a bottom side 26 and a perimeter edge 28 that extends between the top 24 and bottom 26 sides. It is understood that padding will be positioned inside of the shoe 12 as is typically found within shoes for the comfort of the wearer and to cushion the foot. While the assembly 10 is described as being incorporated into a basketball shoe, it should be understood that the disclosure below may be utilized into hiking boots, military boots and other footwear having structure intended to prevent hyper-inverting of the ankle.

Figure 4:
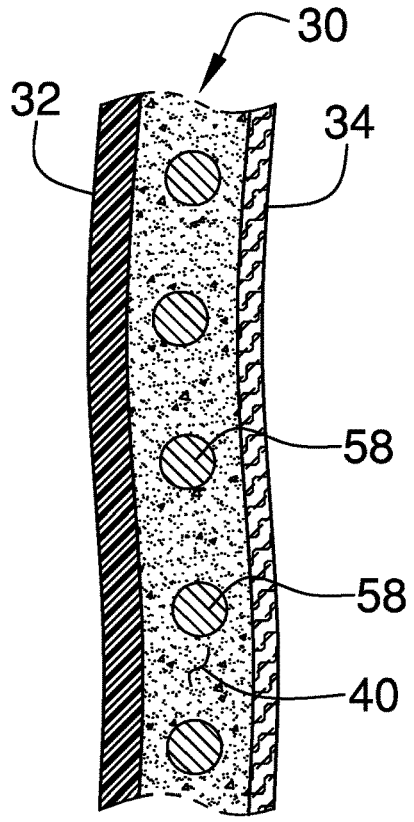
FIG. 4 is a cross-sectional view of an embodiment of the disclosure taken along line 4-4 of FIG. 2.
Figure 5:
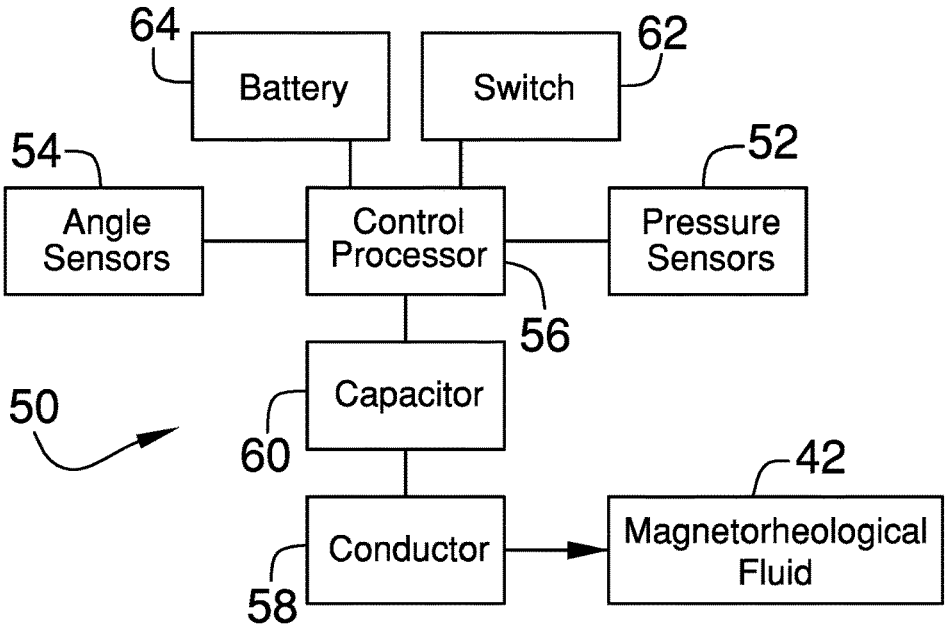
FIG. 5 is a schematic view of an embodiment of the disclosure.

The perimeter wall 16 includes a lining 30 comprising a foamed material 40. As can be seen in FIG. 4, the lining 30 may be positioned between an outer layer 32 and an inner layer 34. The outer 32 and inner 34 layers are comprised of flexible material such as leather, synthetic leather, plastics and other conventional materials used for shoe constructions. The foamed material 40 of the lining 30 is a porous, resiliently compressible material and may be selected from any one of well-known foamed elastomeric materials used in the manufacturing of athletic shoes or used in joint braces. Alternatively, the foamed material 40 may be comprised of a gel material held between the outer 32 and inner 34 layers.

A magnetorheological fluid 42, which may be characterized as a smart fluid, impregnates the foamed material 40. This may thereafter be defined as magnetorheological foam or MR foam. The foamed material 40 may be open cell material with the magnetorheological fluid 42 may be added secondarily or embedded within the foam material 40 during the manufacturing of the foamed material 40. Alternatively, the magnetorheological fluid 42 may be microencapsulated and embedded into the foamed material 40. The magnetorheological fluid 42 is configured to be alternated between a first state wherein the foamed material 40 is bendable and a second state wherein the magnetorheological fluid 42 forms rigid columns and/or a matrix within the foamed material 40 such that the foamed material 40 is not bendable. The lining 30, as MR foam, forms a rigid, supportive and protective shell when the magnetorheological fluid 42 is in the second state. The magnetorheological fluid 42 may be any type of material whose structure is altered from a fluid or malleable one to a rigid one when either an electric field or a magnetic field.

Generally, the magnetorheological fluid 42 may be classified as an electroactive polymer. Electroactive polymers include a class of materials that organize their orientation and relative positions when subjected to magnetic fields or low level electric fields. With their orientations aligned and positioned and retained in a static condition relative to each other, the electroactive polymers, or magnetorheological iron particles, will form rigid columns within the foamed material. This change occurs on the order of milliseconds and is rapidly reversible when the magnetic or electric field is discontinued.

In order to form a more rigid structure to prevent the electroactive polymers from moving in sheets relative to one another when the magnetorheological fluid 42 is in the second state, the magnetorheological fluid 42 may be arranged in a pattern within the foamed material 40. These patterns may take one or multiple ones of many forms. For example, the patterns may include a web pattern, a diamond lattice pattern, helical and double helix shapes and the like.

An actuating system 50 is mounted on the shoe 12 and is in operationally communication with magnetorheological fluid 42. More particularly, this would include, for example, circuitry within the MR foam. The actuating system 50 actuates, or changes, the magnetorheological fluid 42 from the first state to the second state when a condition has been met and the actuating system actuates 50 the magnetorheological fluid 42 from the second state to the first state when a deactivation event occurs. The deactivation event may include a predetermined amount of time, removal of a power source, complete capacitor (or super capacitor) discharge, pressing of a power switch, remote activation or other input mechanisms.

The condition is met when the actuating system 50 detects a combination of a threshold angle and/or a threshold pressure that has been surpassed by the sole 14. To that end, the actuating system 50 includes a pressure sensor 52 that is mounted on the shoe 12 and detects an amount of force being exerted to the sole 14. The pressure sensor 52 may comprise a plurality of pressure sensors 52 and the pressure sensors 52 may be mounted within the sole 14 of the shoe 12. The total pressure on the sole 14 is measured to indicate that the shoe 12 is being used during a jumping or landing action. Because the total pressure is a factor of the weight of the person wearing the shoe, the threshold pressure will vary depending on the size of the shoe or may be adjusted to accommodate the person's weight. Typically the threshold pressure will be greater than two times the weight of the person.

An angle sensor 54 is mounted on the shoe 12 and detects an angle of orientation of the sole 14 to detect the threshold angle. More specifically, the angle sensor 54 detects lateral and angular displacement of the shoe 12. Thus, the angle of the bottom side 26 of the sole 12 from a toe end of the shoe 12 relative to a heal end of the sole 14 will not affect the angle sensor 54. However, the angle sensor 54 will be affected by an angle of the plane of the bottom side 26 of the sole 14 along a line extending between a left lateral side and a right lateral side of the shoe 12. Should that angle detected by the angle sensor 54 be greater than the threshold angle, which will typically be greater than 20°, relative to a horizontal plane, and may be greater than 30°, it will indicate that the user of the shoe 12 is in the process of stretching and possibly tearing ligaments within their ankle. As with the pressure sensor 52, a plurality of angle sensors 54 may be provided and each may be mounted within the sole 14. In such a case, the assembly 10 may require multiple ones of the angle sensors 54 detecting the angle of the shoe 12 being greater than the threshold ankle in order to activate the MR foam to the second state.

Alternatively, instead of including both pressure sensors 52 and angle sensors 54, the actuating system 50 may include only pressure sensors 52 positioned in the lateral edges of the sole 14. Large pressures positioned in one lateral edge but not the other would indicate that the wearer of the shoe 12 has landed on the edge detecting the pressure and that the ankle of the person is rolling outwardly or hyper inverting the ankle and potentially damaging the ligaments thereof. The shoe 12 may be constructed such that the sole 14 edge is formed to be angled equal to the threshold angle but include the pressure sensors in the perimeter edge 28 so that pressure at that edge would indicate that the shoe 12 is experiencing pressure forces at that angle and therefore the condition is being met.

A control processor 56 is in communication with the pressure sensor 52 and the angle sensor 54. The control processor 56 may be electrically coupled to the pressure 52 and angle 54 sensors or wirelessly coupled to the pressure 52 and angle 54 sensors. A conductor 58, which is an electrical conductor, and a capacitor 60, are operationally coupled to the control processor 56. The conductor 58 is operationally coupled to the magnetorheological fluid 42 and in general this will entail being in close proximity to the MR foam and may be embedded within the MR foam such that it will subject the MR foam to a magnetic field or electric discharge when energized. Multiple capacitors 60 may be arranged in parallel circuits to provide more current to multiple coils of conductors 58 positioned within the MR foam. The conductor 58 is not energized, or is turned off to cause the magnetorheological fluid 42 to enter the first state and energized, or turned on, by the capacitor(s) 60 to cause the magnetorheological fluid to enter the second state. If capacitors 60 are utilized, once they are fully discharged, the MR foam will return to the first state. The actuating system 50 is generally in a powered on state though a switch 62, either mechanically mounted on the shoe 12 or in remote communication with the control processor, may be utilized to turn the actuating system 50 on or off.

Depending on the type of magnetorheological fluid 42 to be used within the foamed material 40, the conductor 58 may create an electric field or a magnetic field when the conductor 58 is energized. As can be seen in FIG. 4, the conductor 58 may include insulated wires forming coils extending through the foamed material 40. The coils may themselves be contained within an elastomeric material in a series of round coils making a web like pattern to protect the insulated wires from impact damage. This web of coils may also be placed immediately adjacent to but not within the foamed material 40.

During usage of the shoe assembly 10, the control processor 56 receives data from the pressure sensor 52 and the angle sensor 54 and energizes the conductor 58 when the condition is met. The electrons flow through the conductor 58, or coil, to create a magnetic field and therefore induction of a magnetic field to cause the foamed material 40 to rapidly enter the second state to become rigid and thereby preventing the ankle from bending. A power source, or battery 64, is electrically coupled to the control processor and the conductor. The power source is also electrically coupled to the angle 54 and pressure 52 sensors. The power source may comprise a rechargeable battery that is recharged through a kinetic energy harvesting source mounted on the shoe 12.

In use, the shoe assembly 10 is worn in used in a conventional manner. However when a threshold angle deflection is detected, in combination with a specific amount of force, electrons from the capacitor 60 flow through the conductor 58, or wires, to induce a magnetic field. This causes the foamed material 40 to enter the second state to prevent ligament damage to the wearer's ankle. Upon the occurrence of the deactivation event, the MR foam returns to the first state to facilitate removal of the shoe 12 for examination of the person's ankle for injuries or to allow continued use of the shoe 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An athletic footwear assembly configured to become rigid when a deflection event occurs to prevent injury to a person's ankle, said assembly comprising:

a shoe including a sole and a perimeter wall being attached to and extending upwardly from said sole, said perimeter wall being configured to receive a foot, said sole having a top side, a bottom side and a perimeter edge extending between said top and bottom sides, said perimeter wall including a vamp, heel panel and an upper;

said perimeter wall including a lining comprising a foamed material;

a magnetorheological fluid impregnating said foamed material, said magnetorheological fluid being configured to be alternated between a first state wherein said foamed material is bendable and a second state wherein said magnetorheological fluid forms rigid columns within said foamed material such that said foamed material is not bendable, said lining forming a rigid and supportive shell when said magnetorheological fluid is in said second state; and an actuating system being mounted on said shoe and being in operational communication with said magnetorheological fluid, said actuating system altering said magnetorheological fluid from said first state to said second state when a condition has been met, said condition being met when said actuating system detects a combination of a threshold angle and a threshold pressure having been surpassed by said sole.

2. The athletic footwear assembly according to claim 1, wherein said foamed material is porous and resiliently compressible.

3. The athletic footwear assembly according to claim 1, wherein said actuating system altering said magnetorheological fluid from said second state to said first state when a deactivation event occurs.

4. The athletic footwear assembly according to claim 1, wherein said actuating system includes:

a pressure sensor being mounted on said shoe and detecting an amount of force being exerted to said sole; and an angle sensor being mounted on said shoe and detecting an angle of orientation of said sole.

5. The athletic footwear assembly according to claim 4, wherein said actuating system includes:

a control processor being in communication with said pressure sensor and said angle sensor;

a conductor for conducting an electric current being operationally coupled to said control processor, said conductor being operationally in communication with said magnetorheological fluid, said conductor being energized to cause said magnetorheological fluid to enter said first state and de-energized to cause said magnetorheological fluid to enter said second state, said control processor receiving data from said pressure sensor and said angle sensor and energizing said conductor on when said condition is met.

6. The athletic footwear assembly according to claim 5, wherein said conductor electrifies said magnetorheological fluid or creates a magnetic field when said conductor is energized with electricity.

7. The athletic footwear assembly according to claim 5, wherein said actuating system includes a capacitor being electrically coupled to said control processor.

8. An athletic footwear assembly configured to become rigid when a deflection event occurs to prevent injury to a person's ankle, said assembly comprising:

a shoe including a sole and a perimeter wall being attached to and extending upwardly from said sole, said perimeter wall being configured to receive a foot, said sole having a top side, a bottom side and a perimeter edge extending between said top and bottom sides, said perimeter wall including a vamp, heel panel and an upper;

said perimeter wall including a lining comprising a foamed material, said foamed material being porous, said foamed material being resiliently compressible, said foamed material comprising a foamed elastomeric material;

a magnetorheological fluid impregnating said foamed material, said magnetorheological fluid being configured to be alternated between a first state wherein said foamed material is bendable and a second state wherein said magnetorheological fluid forms rigid columns within said foamed material such that said foamed material is not bendable, said lining forming a rigid and supportive shell when said magnetorheological fluid is in said second state, said magnetorheological fluid being arranged in a pattern within said foamed material;

an actuating system being mounted on said shoe and being in operational communication with said magnetorheological fluid, said actuating system altering said magnetorheological fluid from said first state to said second state when a condition has been met, said actuating system altering said magnetorheological fluid from said second state to said first state when a deactivation event occurs, said condition being met when said actuating system detects a combination of a threshold angle and a threshold pressure having been surpassed by said sole, said actuating system including:

a pressure sensor being mounted on said shoe and detecting an amount of force being exerted to said sole;

an angle sensor being mounted on said shoe and detecting an angle of orientation of said sole;

a control processor being in communication with said pressure sensor and said angle sensor;

a conductor for conducting an electric current being operationally coupled to said control processor, said conductor being in communication with said magnetorheological fluid, said conductor being energized to cause said magnetorheological fluid to enter said first state and de-energized to cause said magnetorheological fluid to enter said second state, said conductor electrifying said magnetorheological fluid or creating a magnetic field when said conductor is energized with electricity;

said control processor receiving data from said pressure sensor and said angle sensor and energizing said conductor on when said condition is met; and a power source being electrically coupled to said control processor and said conductor.

* * * * *